US008646703B2

(12) United States Patent
Hodgson et al.

(10) Patent No.: US 8,646,703 B2
(45) Date of Patent: Feb. 11, 2014

(54) FLOW ADJUSTMENT ORIFICE SYSTEMS FOR FUEL NOZZLES

(75) Inventors: Bryan Eugene Hodgson, Easley, SC (US); Rachel Christner Howard, Chicago, IL (US)

(73) Assignee: General Electric Company, Schenectady, NY (US)

( * ) Notice: Subject to any disclaimer, the term of this patent is extended or adjusted under 35 U.S.C. 154(b) by 69 days.

(21) Appl. No.: 13/212,683

(22) Filed: Aug. 18, 2011

(65) Prior Publication Data

US 2013/0043324 A1 Feb. 21, 2013

(51) Int. Cl.

| | |
|---|---|
| ***F23D 11/10*** | (2006.01) |
| ***F23D 14/62*** | (2006.01) |
| ***B05B 7/04*** | (2006.01) |
| ***B05B 7/06*** | (2006.01) |
| ***F02C 1/00*** | (2006.01) |

(52) U.S. Cl.

USPC ..... 239/428; 239/418; 239/419; 239/423; 239/424.5; 239/434.5; 239/596; 60/737

(58) Field of Classification Search

USPC ..... 239/71, 76, 428, 432, 553, 553.3, 239/553.5, 554, 555, 558, 568, 596; 60/737, 742

See application file for complete search history.

(56) References Cited

U.S. PATENT DOCUMENTS

| | | | | |
|---|---|---|---|---|
| 2,968,925 | A * | 1/1961 | Blevans et al. | 60/740 |
| 5,685,139 | A | 11/1997 | Mick et al. | |
| 6,532,742 | B2 * | 3/2003 | Scarinci et al. | 60/725 |
| 6,959,550 | B2 * | 11/2005 | Freeman et al. | 60/725 |
| 8,276,836 | B2 * | 10/2012 | MacMillan et al. | 239/596 |
| 2005/0284965 | A1 | 12/2005 | Schneider | |
| 2009/0008474 | A1 | 1/2009 | Miyake | |
| 2009/0320483 | A1 | 12/2009 | Storey et al. | |
| 2011/0079667 | A1 | 4/2011 | Stastny et al. | |
| 2011/0107764 | A1 | 5/2011 | Bailey et al. | |
| 2011/0107768 | A1 | 5/2011 | Niemeyer et al. | |
| 2011/0173983 | A1 | 7/2011 | Pinson et al. | |

FOREIGN PATENT DOCUMENTS

| | | | |
|---|---|---|---|
| DE | 102008002940 | A1 | 1/2009 |
| EP | 1286111 | A2 | 2/2003 |

OTHER PUBLICATIONS

Search Report and Written Opinion from EP Application No. 12179935.7 dated Jan. 4, 2013.

* cited by examiner

*Primary Examiner* — Ryan Reis

(74) *Attorney, Agent, or Firm* — Blake A. Nickles; Ernest G. Cusick; Frank A. Landgraff

(57) ABSTRACT

Flow adjustment orifice systems for fuel nozzles include a metering plate that connects to an air/fuel inlet end of a fuel nozzle and a plurality of metering orifices disposed about the metering plate that align with a plurality of air/fuel inlet orifices on the air/fuel inlet end of the fuel nozzle, wherein at least one of the plurality of metering orifices reduces an open cross-sectional area for at least one of the air/fuel inlet orifices.

18 Claims, 5 Drawing Sheets

FLOW ADJUSTMENT ORIFICE SYSTEMS FOR FUEL NOZZLES

BACKGROUND OF THE INVENTION

The subject matter disclosed herein relates to fuel nozzles and, more specifically, to flow adjustment orifice systems for fuel nozzles.

Gas turbines can utilize fuel nozzles to direct the flow of air and/or fuel for combustion. Exemplary air and/or fuel combustion components can include compressed air, gas, oil and other combustible fuels. These air and/or fuel combustion components may be directed from their original source, through the fuel nozzle, and into a combustion area where the air and/or fuel is ultimately combusted. This combustion may then drive the rotation of the gas turbine during its operation.

When the air and/or fuel is directed through the fuel nozzle, it may pass through one or more orifices, channels, segments and/or other types of pathways. Thus, the dimensions of these pathways, such as the open cross-sectional area for an air/fuel inlet orifice, may assist in controlling the amount of air and/or fuel that passes through the fuel nozzle for combustion. However, these various pathways may wear over time due to, for example, the air/fuel itself passing there through, the overall operating conditions of the fuel nozzle, or various other elemental conditions such as foreign particulates or abrasions. The wearing of the pathways may in turn affect the amount of air and/or fuel passing through the fuel nozzle and potentially result in a non-uniform or excessive combustion. For example, when an air/fuel inlet orifice becomes worn, it may have a greater open cross-sectional area than originally designed and result in an excess of air/fuel passing through the fuel nozzle for combustion. While additional material may be added to worn fuel nozzles (e.g., via welding) to return the worn fuel nozzles to their original size and shape, such processes may be labor intensive and difficult to accomplish with consistent precision.

Accordingly, alternative flow adjustment orifice systems for fuel nozzles and metered fuel nozzles incorporating the same would be welcome in the art.

BRIEF DESCRIPTION OF THE INVENTION

In one embodiment, a flow adjustment orifice system for a fuel nozzle is disclosed. The flow adjustment orifice system can include a metering plate that connects to an air/fuel inlet end of a fuel nozzle and a plurality of metering orifices disposed about the metering plate. The plurality of metering orifices can align with a plurality of air/fuel inlet orifices on the air/fuel inlet end of the fuel nozzle so that at least one of the plurality of metering orifices reduces an open cross-sectional area for at least one of the air/fuel inlet orifices.

In another embodiment, a flow adjustment orifice system for a fuel nozzle is disclosed. The flow adjustment orifice system can include a first metering plate having a first plurality of metering orifices that align with a first plurality of air/fuel inlet orifices on an air/fuel inlet end of a fuel nozzle. At least one of the first plurality of metering orifices can thereby reduce an open cross-sectional area for at least one of the first plurality of air/fuel inlet orifices. The flow adjustment orifice system can further include a second metering plate having a second plurality of metering orifices that align with a second plurality of air/fuel inlet orifices on the air/fuel inlet end of the fuel nozzle. At least one of the second plurality of metering orifices can reduce a second open cross-sectional area for at least one of the second plurality of air/fuel inlet orifices.

In yet another embodiment a metered fuel nozzle for metered air/fuel inlet flow is disclosed. The metered fuel nozzle can include a first plurality of air/fuel inlet orifices disposed on an air/fuel inlet end of the metered fuel nozzle and a first metering ring connected to the air/fuel inlet end of the metered fuel nozzle. The metered fuel nozzle can further include a first plurality of metering orifices disposed about the first metering ring in alignment with first plurality of air/fuel inlet orifices such that at least one of the first plurality of metering orifices reduces an open cross-sectional area for at least one of the first plurality of air/fuel inlet orifices.

These and additional features provided by the embodiments discussed herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the inventions defined by the claims. The following detailed description of the illustrative embodiments can be understood when read in conjunction with the following drawings, where like structure is indicated with like reference numerals and in which:

DETAILED DESCRIPTION OF THE INVENTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements.

The terms "comprising," "including," and "having" are intended to be inclusive and mean that there may be additional elements other than the listed elements.

Flow adjustment orifice systems for fuel nozzles disclosed herein generally comprise at least one metering plate (e.g., a ring) containing a plurality of metering orifices that alight with a plurality of air/fuel inlet orifices on the air/fuel inlet end of the fuel nozzle. By connecting the at least one metering plate to the fuel nozzle, the plurality of metering orifices can reduce the open cross-sectional area of one or more of the plurality of air/fuel inlet orifices to meter the amount of air and/or fuel that can flow there through. The ability to reduce the open cross-sectional area of one or more of the air/fuel inlet orifices using the flow adjustment orifice system can return the amount of air and/or fuel that flows through a worn fuel nozzle to the original levels.

Figure 1:
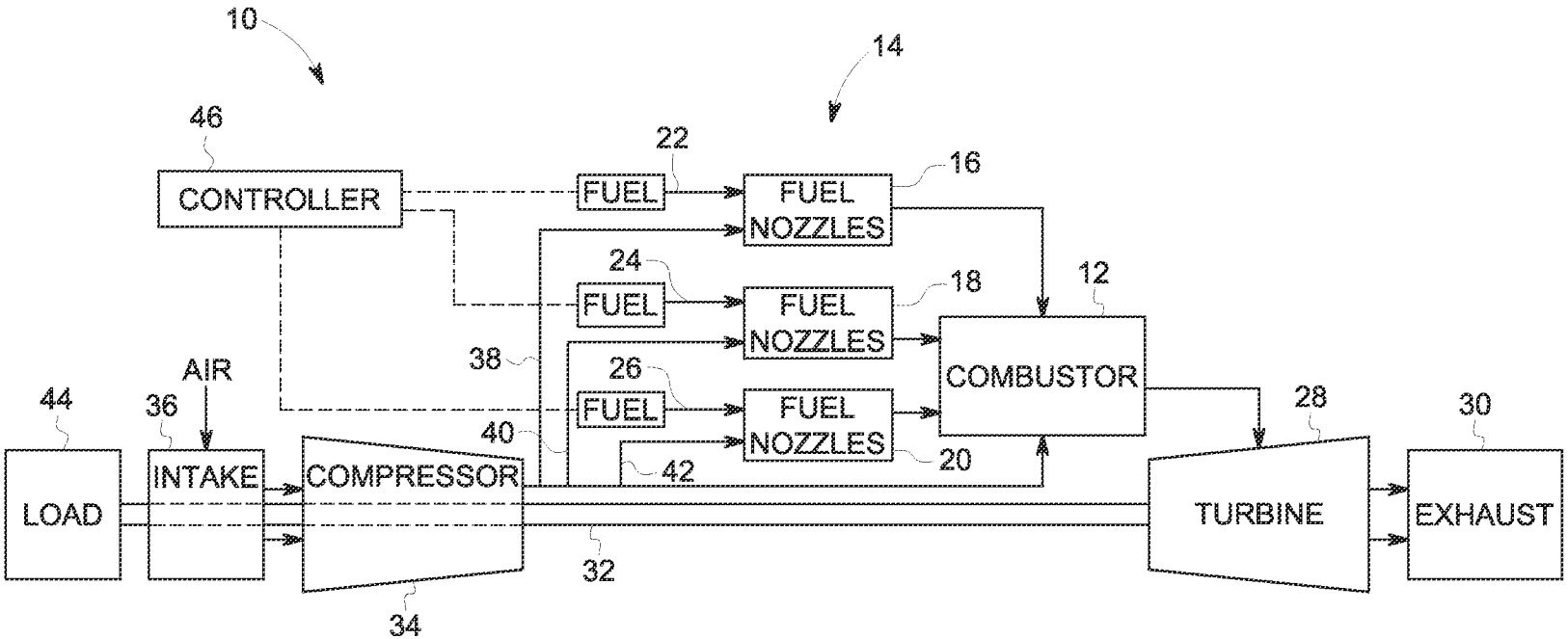
FIG. 1 is a schematic flow diagram of a turbine system having a combustor with a plurality of fuel nozzles according to one or more embodiments shown or described herein.

Referring now to FIG. 1, a schematic flow diagram of an embodiment of a turbine system 10 having a combustor 12 with a plurality of fuel nozzles 14 is illustrated. The turbine system 10 may use one or more liquid or gas fuels, such as natural gas and/or a hydrogen rich synthetic gas. As depicted, the fuel nozzles 14 may intake a plurality of fuel supply streams 22, 24, 26. For example, a first group of fuel nozzles 16 may intake a first fuel supply stream 22, a second group of fuel nozzles 18 may intake a second fuel supply stream 24, and a third group of fuel nozzles 20 may intake a third fuel supply stream 26. Each of the fuel supply streams 22, 24, 26 may mix with a respective air stream, and be distributed as an air/fuel mixture into the combustor 12.

The air/fuel mixture can combust in a chamber within the combustor 12, thereby creating hot pressurized exhaust gases. The combustor 12 directs the exhaust gases through a turbine 28 toward an exhaust outlet 30. As the exhaust gases pass through the turbine 28, the gases can force one or more turbine blades to rotate a shaft 32 along an axis of the turbine system 10. As illustrated, the shaft 32 may be connected to various components of the turbine system 10, including a compressor 34. The compressor 34 can also include blades that may be coupled to the shaft 32. As the shaft 32 rotates, the blades within the compressor 34 also rotate, thereby compressing air from an air intake 36 through the compressor 34 and into the fuel nozzles 14 and/or combustor 12. More specifically, a first compressed air stream 38 may be directed into the first group of fuel nozzles 16, a second compressed air stream 40 may be directed into the second group of fuel nozzles 18, and a third compressed air stream 42 may be directed into the third group of fuel nozzles 20. The shaft 32 may also be connected to a load 44, which may be a vehicle or a stationary load, such as an electrical generator in a power plant or a propeller on an aircraft, for example. The load 44 may include any suitable device capable of being powered by the rotational output of turbine system 10. In addition, the turbine system 10 may include a controller 46 configured to control the first, second, and third fuel supply streams 22, 24, 26 into the first, second, and third groups of fuel nozzles 16, 18, and 20, respectively. More specifically, the first, second, and third fuel supply streams 22, 24, 26 may be controlled independently from each other by the controller 46.

Figure 2:
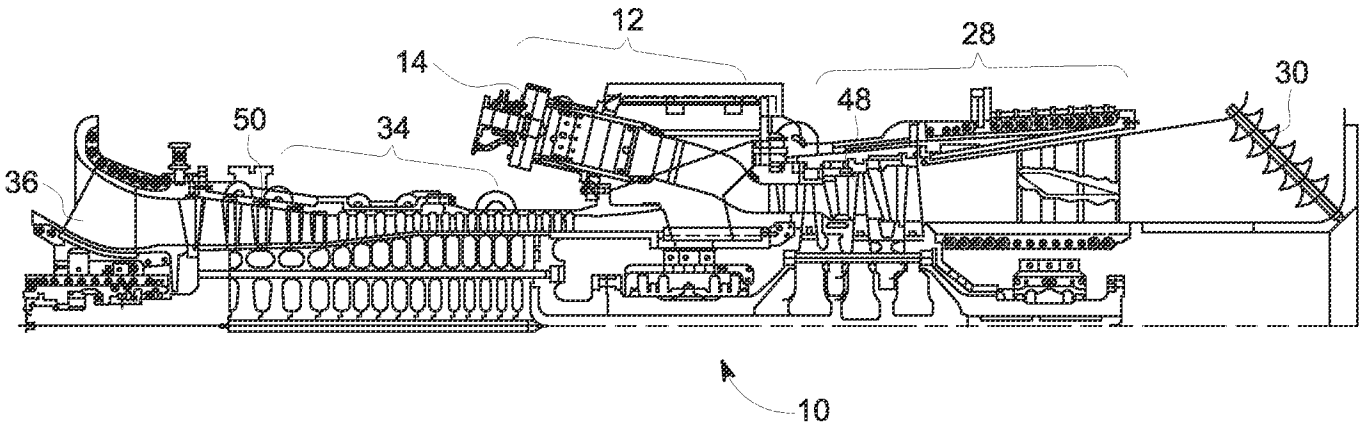
FIG. 2 is a cross-sectional side view of the turbine system in FIG. 1 according to one or more embodiments shown or described herein.

FIG. 2 is a cross-sectional side view of an exemplary embodiment of the turbine system 10, as illustrated in FIG. 1. The turbine system 10 can include one or more fuel nozzles 14 located inside one or more combustors 12. In operation, air enters the turbine system 10 through the air intake 36 and is pressurized in the compressor 34. The compressed air may then be mixed with fuel for combustion within the combustor 12. For example, the fuel nozzles 14 may inject an air/fuel mixture into the combustor 12 in a suitable ratio for optimal combustion, emissions, fuel consumption, and power output. The combustion can generate hot pressurized exhaust gases, which can then drive one or more blades 48 within the turbine 28 to rotate the shaft 32 and, thus, the compressor 34 and the load 44. The rotation of the turbine blades 48 can cause a rotation of the shaft 32, thereby causing blades 50 within the compressor 34 to draw in and pressurize the air received by the air intake 36.

Figure 3:
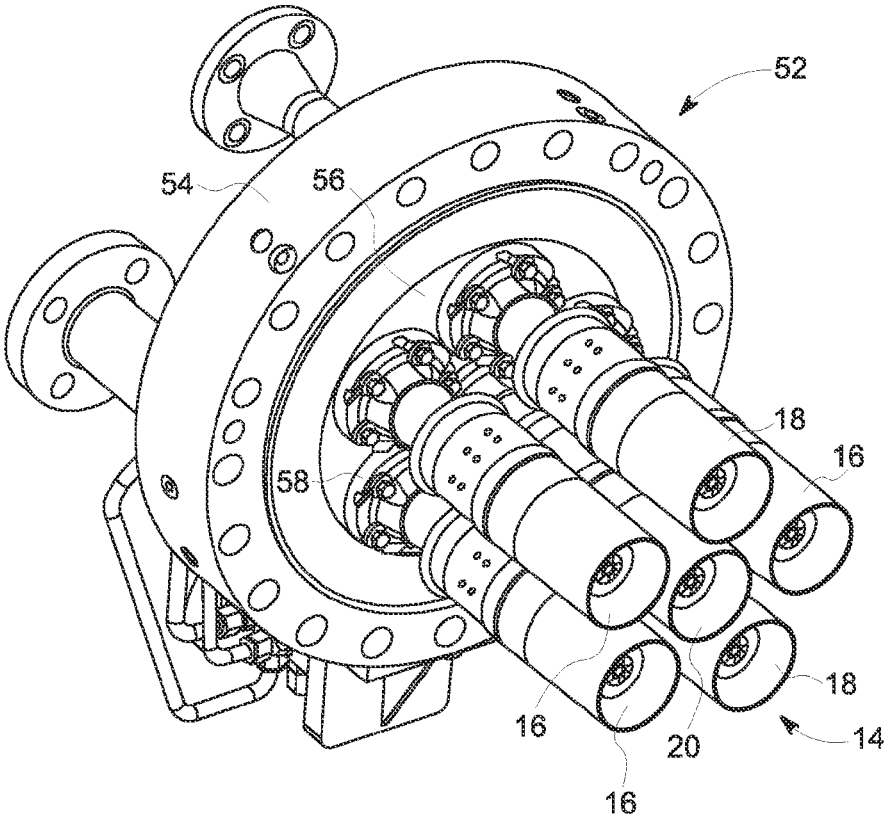
FIG. 3 is a perspective view of a combustor head end of the gas turbine illustrated in FIG. 2 according to one or more embodiments shown or described herein.

Referring now to FIG. 3, a detailed perspective view of an embodiment of a combustor head end 52 is illustrated having an end cover 54 with the plurality of fuel nozzles 14 attached to an end cover base surface 56 via sealing joints 58. The head end 52 routes air/fuel (e.g., the compressed air from the compressor 34 and/or the fuel through end cover 54) to each of the fuel nozzles 14, which may partially pre-mix the compressed air and fuel as an air-fuel mixture prior to entry into a combustion zone in the combustor 12. In some embodiments, the fuel nozzles 14 may further comprise one or more swirl vanes configured to induce swirl in an air flow path, wherein each swirl vane includes fuel injection ports configured to inject fuel into the air flow path.

Figure 4:
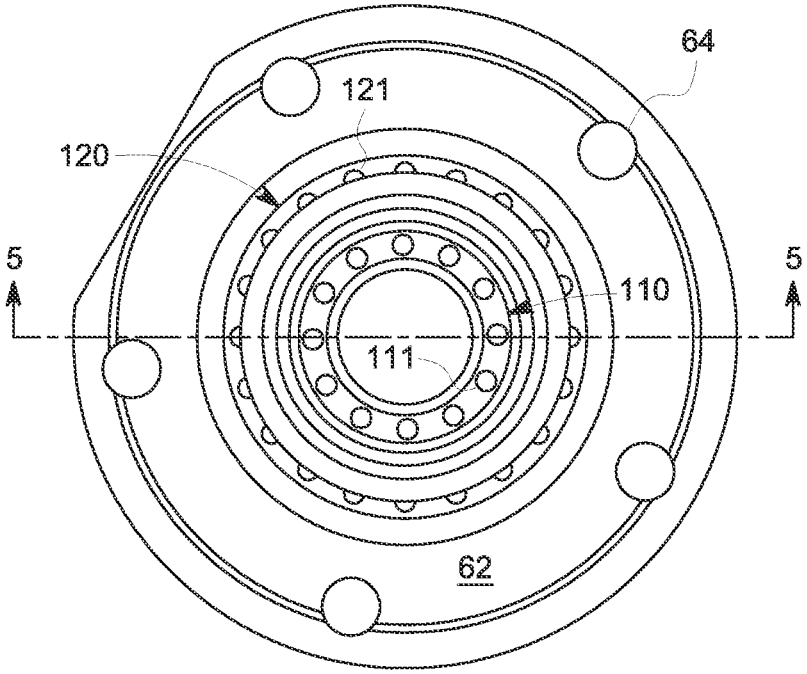
FIG. 4 is a top view of an air/fuel inlet end of a fuel nozzle illustrated in FIG. 3 according to one or more embodiments shown or described herein.
Figure 5:
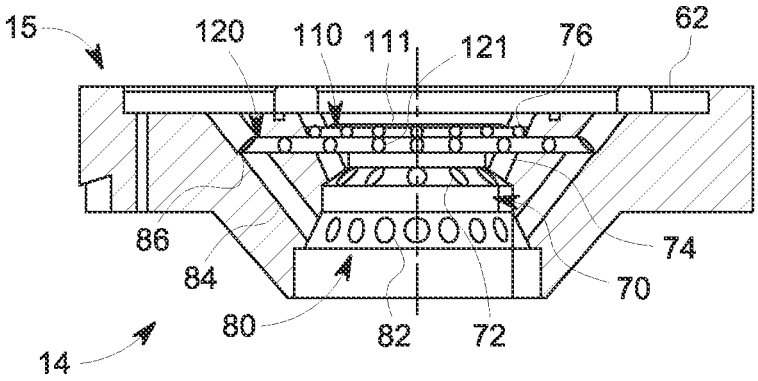
FIG. 5 is a cross-sectional view of the fuel nozzle illustrated in FIG. 4 according to one or more embodiments shown or described herein.

Referring now to FIGS. 3-5, an air/fuel inlet end 15 of the fuel nozzle 14 comprises a fuel nozzle base surface 62 with one or more air/fuel paths 70 and 80. The fuel nozzle base surface 62 comprises the surface of the fuel nozzle 14 that contacts the end cover base surface 56 of the combustor head end 52 when connected using the sealing joints 58 as illustrated in FIG. 3. The end cover base surface 56 and the fuel nozzle base surface 62 can be joined to allow for the passage of air and/or fuel ("air/fuel") through the combustor head end 52 and into the one or more air/fuel paths 70 and 80 of the fuel nozzles 14. For example, in some embodiments, the sealing joints 58 may comprise a plurality of bolt holes 64 disposed around the circumference of the fuel nozzle 14 that can align with complimentary holes in the end cover base surface 56 of the combustor head end 52 such that bolts may be used to connect the two pieces together as illustrated in FIG. 3. However, any other suitable connection may additionally or alternative be used to connect the plurality of fuel nozzles 14 to the combustor head end 52 such that air and/or fuel may pass there between.

Once the fuel nozzle 14 is connected to the combustor head end 52, the one or more air/fuel paths 70 and 80 can receive and direct the flow of air and/or fuel from the air/fuel inlet end 15 and through the fuel nozzle 14 for subsequent combustion. The one or more air/fuel paths 70 and 80 can thereby comprise any pathway or pathways that receive air and/or fuel from one end of the fuel nozzle 14 (e.g., about the fuel nozzle base surface 62) and directs it towards the other end of the fuel nozzle 14 for combustion.

For example, as illustrated in FIGS. 4 and 5, in some embodiments, a first fuel path 70 can comprise one or more first air/fuel internal channels 72 that extend the length of the fuel nozzle 14 to direct the air and/or fuel towards the combustion end. In some embodiments, the one or more first air/fuel internal channels 72 may be connected to a first plurality of air/fuel inlet orifices 76 via one or more first air/fuel connection segments 74. Each of the first plurality of air/fuel inlet orifices 76 can comprise an open cross-sectional area that allows for the passage of air and/or fuel into the fuel nozzle 14 (and more specifically, in towards the one or more first air/fuel internal channels 72). Where present, the one or more first air/fuel connection segments 74 can connect the first plurality of air/fuel inlet orifices 76 to the one or more first air/fuel internal channels 72 as illustrated in FIG. 5. The one or more first air/fuel connection segments 74 can thereby direct the incoming air and/or fuel from the first plurality of air/fuel inlet orifices 76 to the one or more first air fuel internal channels 72 when the two are not inherently in direct alignment (e.g., when the one or more first air/fuel internal channels 72 are more interior the fuel nozzle 14 than the first plurality of air/fuel inlet orifices 76 as illustrated in FIG. 5.)

In some embodiments, such as that illustrated in FIGS. 4 and 5, the first plurality of air/fuel inlet orifices 76 can be aligned in a substantially circular orientation. In other embodiments, the first plurality of air/fuel inlet orifices 76 can comprise any other orientation that allows for the passage of air and/or fuel for combustion such as, for example, a star-pattern orientation. Moreover, while FIG. 4 illustrates a first air/fuel path 70 with twelve air/fuel inlet orifices, it should be appreciated that the first air/fuel path 70 can alternatively comprise any number of air/fuel inlet orifices 76 that allows for the passage of air and/or fuel for combustion.

Still referring to FIGS. 4 and 5, in some embodiments, the fuel nozzle 14 may comprise a second air/fuel path 80. The second air/fuel path 80 can provide for an additional pathway system for air and/or fuel to pass through the fuel nozzle 14. For example, in some embodiments, the first air/fuel path 70 may be utilized for the passage of compressed air, while the second air/fuel path 80 may be utilized for the passage of combustible fuel (e.g., natural gas). Similar to the first air/fuel path 70, the second air/fuel path 80 can comprise one or more second air/fuel internal channels 82 that extend the length of the fuel nozzle 14 to direct the air and/or fuel towards the combustion end. Likewise, in some embodiments, the one or more second air/fuel internal channels 82 may be connected to a second plurality of air/fuel inlet orifices 86 via one or more second air/fuel connection segments 84. Each of the second plurality of air/fuel inlet orifices 86 can comprise a second open cross-sectional area that allows for the passage of air and/or fuel into the fuel nozzle 14 (and more specifically, in towards the one or more second air/fuel internal channels 82).

In embodiments comprising a plurality of air/fuel paths 70 and 80, the first plurality of air/fuel inlet orifices 76 and the second plurality of air/fuel inlet orifices 86 may be concentric such that the plurality of air/fuel inlet orifices 76 and 86 form a series of rings (as illustrated in FIG. 4). Alternatively, the first plurality of air/fuel inlet orifices 76 and the second plurality of air/fuel inlet orifices 86 can comprise any other configurations and may potentially be aligned with one another (e.g., wherein the location of the first plurality of air/fuel inlet orifices 76 is symmetrical with the location of the second plurality of air/fuel inlet orifices 86), or can alternatively be oriented and/or disposed independent of one another.

Figure 6:
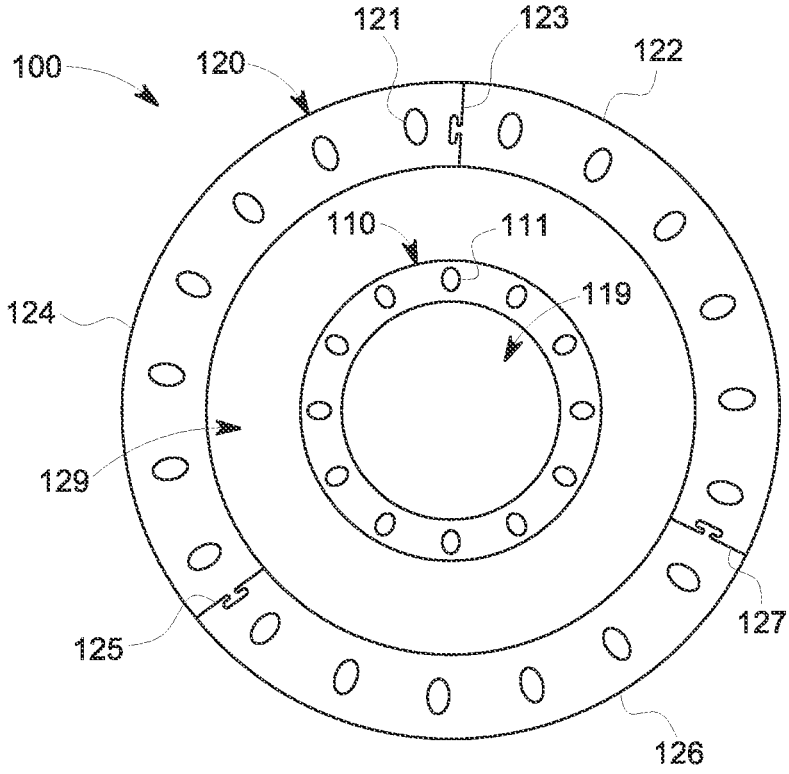
FIG. 6 is a top view of an exemplary flow adjustment orifice system with two metering plates according to one or more embodiments shown or described herein.
Figure 7:
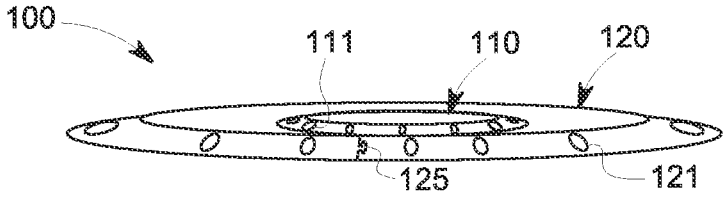
FIG. 7 is a side view of the exemplary flow adjustment orifice system illustrated in FIG. 6 according to one or more embodiments shown or described herein.

Referring now to FIGS. 3-7, the fuel nozzle 14 can comprise a metered fuel nozzle 14 in which the fuel nozzle 14 comprises a flow adjustment orifice system 100 to meter the amount of air and/or fuel passing from the combustor head end 52 into the fuel nozzle 14. As best illustrated in FIGS. 6 and 7, the flow adjustment orifice system 100 can comprise one or more metering plates 110 and 120 each comprising a plurality of metering orifices 111 and 121.

With reference to a single (first) metering plate 110, the metering plate 110 can connect to an air/fuel inlet end 15 of the fuel nozzle 14 (e.g., on the fuel nozzle base surface 62) such that the plurality of metering orifices 111 on the metering plate 110 can align with the first plurality of air/fuel inlet orifices 76 of the first air/fuel path 70 in the fuel nozzle 14. In some embodiments, such as that illustrated in FIGS. 4-7, the metering plate 110 can comprise a metering ring with a void interior section 119. Such embodiments may provide the plurality of metering orifices while reducing the area of contact between the metering plate 110 and the fuel nozzle 14 thereby reducing the amount of material invested in the metering plate 110. However, in some embodiments, the metering plate 110 can comprise other alternative structures such as square or circular plates (with or without a void interior section 119) depending on the size and shape constraints necessitated by the space between the combustor head end 52 and the fuel nozzle 14. In some embodiments, the metering plate 110 may directly attach to another part adjacent the fuel nozzle 14 so that the metering plate 110 physically makes contact with (i.e., connects to) the fuel nozzle 14 when the fuel nozzle 14 is connected to that other part. For example, in some embodiments, the metering plate 110 may attach to the combustor head end 52 so that when the fuel nozzle 14 is bolted to the combustor head end 52, the metering plate 110 connects to the fuel nozzle through physical contact.

The metering plate 110 of the flow adjustment orifice system 100 further comprises the plurality of metering orifices 111. The plurality of metering orifices 111 can each comprise an open pathway through the metering plate 110 such that air and/or fuel may pass there through. Each of the plurality of metering orifices 111 can comprise a specific geometry to regulate the amount of air and/or fuel that can pass through at any given time. For example, to allow a greater amount of air and/or fuel through the flow adjustment orifice system 100 (such as to increase the amount of combustion in the combustor 12), each of the plurality of metering orifices 111 may comprise a relatively greater cross-sectional area. Alternatively, to allow a lesser amount of air and/or fuel through the flow adjustment orifice system 100 (such as to reduce the amount of combustion in the combustor 12), each of the plurality of metering orifices 111 may comprise a relatively smaller cross-sectional area.

In some embodiments, each of the plurality of metering orifices 111 may comprise a uniform cross-sectional profile (i.e., uniform size and shape so that the amount of air/fuel passing through each of the plurality of metering orifices is substantially uniform). For example, in some embodiments, each of the plurality of metering orifices may comprise the cross-sectional profile that matches the original open cross-sectional area for the air/fuel inlet orifices 76. In such embodiments, when the air/fuel inlet orifices 76 become worn and comprise a greater-than-original open cross-sectional area that allows excess air/fuel to flow there through, the placement of the plurality of metering orifices 111 of the metering plate 110 over the plurality of air/fuel inlet orifices 76 may return the amount of air/fuel that flows through the fuel nozzle 14 to its original amount by reducing the open cross-sectional area of the air/fuel inlet orifices 76 to their original condition. However, it should also be appreciated that in some embodiments, the plurality of metering orifices 111 may comprise different sizes and shapes such that the plurality of metering orifices 111 are non-uniform.

While reference has been made to a single metering plate 110, in some embodiments the flow adjustment orifice system 100 can comprise a plurality of metering plates, such as including a second metering plate 120 in addition to the first metering plate 110 as illustrated in FIGS. 4-7. The second metering plate 120 can connect to the air/fuel inlet end 15 of the fuel nozzle 14 and comprise a second plurality of metering orifices 121 disposed about the second metering plate 120 that align with the second plurality of air/fuel inlet orifices 86 on the air/fuel inlet end 15 of the fuel nozzle 14. Moreover, at least one of the second plurality of metering orifices 121 can reduce a second open cross-sectional area for at least one of the second plurality of air/fuel inlet orifices 86. Thus, when the fuel nozzle 14 comprises a first air/fuel path 70 (e.g., for compressed air) and a second air/fuel path 80 (e.g., for natural gas), the first plurality of metering orifices 111 of the first metering plate 110 can meter the amount of air/fuel flowing through the first air/fuel path 70 by reducing the open cross-sectional area for at least one of the first plurality of air/fuel inlet orifices 76, and the second plurality of metering orifices 121 of the second metering plate 120 can meter the amount of air/fuel flowing through the second air/fuel path 80 by reducing the second open cross-sectional area for at least one of the second plurality of air/fuel inlet orifices 86.

Similar to the first plurality of air/fuel inlet orifices 76 and the second plurality of air/fuel inlet orifices 86, in some embodiments, the first metering plate 110 and the second metering plate 120 can be aligned with one another (e.g., wherein the location of the first plurality of metering orifices 111 is symmetrical with the location of the second plurality of metering orifices 121). For example, in some embodiments, such as when the first metering plate 110 and the second metering plate 120 both comprise metering rings having a first void interior section 119 and a second interior void section 129 respectively, the first metering plate 110 and the second metering plate 120 may comprise concentrically aligned first and second metering rings such as illustrated in FIGS. 4-7. However, it should be appreciated that any other number of metering plates comprising any other various shapes and disposed with any other relative alignment (e.g., side-by side) may also be utilized.

Moreover, in some embodiments, as illustrated in the second metering plate 120 in FIG. 6, one or more of the metering plates may comprise a plurality of segments 122, 124 and 126 that are separable from one another. The plurality of segments 122, 124 and 126 may then be connected to the air/fuel inlet end 15 of the fuel nozzle 14 as separate pieces that come together once in place. Such embodiments may allow for the connection of a segmented metering plate (e.g., the second metering plate 120 illustrated in FIG. 6) to the air/fuel inlet end 15 of the fuel nozzle 14 when physical constraints prevent the connection of a solid metering plate (e.g., the first metering plate 110 illustrated in FIG. 6) by individually positioning and/or connecting the first segment 122, the second segment 124, and the third segment 126 (or any other number of segments) about the fuel nozzle 14 before connecting the plurality of segments 122, 124 and 126 to one another.

In addition, in some embodiments where the metering plate comprises a plurality of segments (e.g., the second metering plate 120 and the plurality of segments 122, 124 and 126), the plurality of segments may interlock at a plurality of joints 123, 125 and 127. For example, a first joint 123 may interconnect the first segment 122 to the second segment 124, a second joint 125 may interconnect the second segment 124 to the third segment 126, and a third joint 127 may interconnect the third segment 126 to the first segment 122. In such embodiments, the plurality of joints 123, 125 and 127 may comprise male and female pieces that combine with one another, as illustrated in FIG. 6, or may otherwise comprise any other interlocking configuration. In some embodiments, the plurality of segments 122, 124 and 126 may simply be disposed adjacent one another with no interlocking at the joints 123, 125 and 127 when connected to the fuel nozzle 14. It should be appreciated that while FIG. 6 illustrates a first metering plate 110 comprising a solid construction, and a second metering plate 120 comprising a plurality of segments 122, 124 and 126) that are separable from one another, any other combination of configurations may also be utilized (e.g., a single solid metering plate, a single metering plate comprising a plurality of segments that are separable from one another, two solid metering plates, two metering plates each comprising a plurality of segments that are separable from one another, etc.). Moreover, while the second metering plate 120 illustrated in FIG. 6 comprises the first segment 122, the second segment 124 and the third segment 126, it should be appreciated that metering plates comprising a plurality of segments that are separable from one another may alternatively comprise any other number of segments.

Referring to FIGS. 4 and 5, the flow adjustment orifice system 100 may be connected to the air/fuel inlet end 15 of the fuel nozzle 14 by any type of connection that fixes the plurality of metering orifices (e.g., the first plurality of metering orifices 111 and the second plurality of metering orifices 121) of the one or more metering plates (e.g., the first metering plate 110 and the second metering plate 120) in place relative to the air/fuel inlet orifices (e.g., the first plurality of air/fuel inlet orifices 76 and the second plurality of air/fuel inlet orifices 86) of the fuel nozzle 14. For example, the one or more metering plates 110 and 120 may be connected to the fuel nozzle 14 via welds, stakes, screws, bolts, clasps, brackets or any other suitable connection mechanisms or combinations thereof. Such connection mechanisms may fix the flow adjustment orifice system 100 in place such that it does not move or rotate when air and/or fuel flows from the combustor head end 52 to the fuel nozzle 14 within the combustor 12 of the turbine system 10.

Moreover, the flow adjustment orifice system 100 (comprising at least the first metering plate 110 and potentially the second metering plate 120 or any other additional metering plates) can comprise any material or materials that allow for its connection to the air/fuel inlet end 15 of the fuel nozzle 14 and the reduction of open cross-sectional area for one or more of the plurality of air/fuel inlet orifices (such as the first plurality of air/fuel inlet orifices 76 or the second plurality of air/fuel inlet orifices 86) to meter the amount of air and/or fuel that flows there through. In some embodiments, the metering plate(s) 110 and 120 may comprise a high strength alloy such as an Inconel alloy to provide strong physical properties sometimes required in the combustor 14 of the turbine system 10. In some embodiments, the metering plate(s) 110 and 120 may comprise the same material as the fuel nozzle base surface 62 to provide more uniform material properties between the fuel nozzle 14 and the flow adjustment orifice system 100. However, it should be appreciated that any other materials may alternatively be used that allow for its connection to the air/fuel inlet end 15 of the fuel nozzle 14 and the reduction of open cross-sectional area for one or more of the plurality of air/fuel inlet orifices 76 and 78.

It should now be appreciated that by connecting the flow adjustment orifice system comprising at least one metering plate having a plurality of metering orifices to the air/fuel inlet end of a fuel nozzle, the plurality of metering orifices can reduce the open cross-sectional area of one or more of the air/fuel inlet orifices. Such a connection can therefore meter the amount of air and or fuel that flows through the fuel nozzle without having to add additional material to or otherwise retool the original air/fuel path.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A flow adjustment orifice system for a fuel nozzle, the flow adjustment orifice system comprising:

a metering plate that connects to an air/fuel inlet end of a fuel nozzle;

a plurality of metering orifices disposed about the metering plate that align with a plurality of air/fuel inlet orifices on the air/fuel inlet end of the fuel nozzle, wherein at least one of the plurality of metering orifices reduces an open cross-sectional area for at least one of the air/fuel inlet orifices;

a second metering plate that connects to the air/fuel inlet end of the fuel nozzle and aligns with the first metering plate, the second metering plate having a larger diameter than the first metering plate; and a second plurality of metering orifices disposed about the second metering plate that align with a second plurality of air/fuel inlet orifices on the air/fuel inlet end of the fuel nozzle, wherein at least one of the second plurality of metering orifices reduces a second open cross-sectional area for at least one of the second plurality of air/fuel inlet orifices.

2. The flow adjustment orifice system of claim 1, wherein the metering plate comprises a metering ring.

3. The flow adjustment orifice system of claim 2, wherein the plurality of metering orifices are circumferentially disposed around the metering ring.

4. The flow adjustment orifice system of claim 1, wherein at least one of the metering plate and the second metering plate comprises a plurality of segments that are separable from one another.

5. The flow adjustment orifice system of claim 1, wherein the metering plate and the second metering plate comprise concentrically aligned metering rings.

6. The flow adjustment orifice system of claim 1, wherein the open cross-sectional area for each of the plurality of air/fuel inlet orifices of the fuel nozzle is reduced by a corresponding one of the plurality of metering orifices.

7. The flow adjustment orifice system of claim 1, wherein each of the plurality of metering orifices comprises a uniform cross-sectional profile.

8. A flow adjustment orifice system for a fuel nozzle, the flow adjustment orifice system comprising:

a first metering plate comprising a first plurality of metering orifices that align with a first plurality of air/fuel inlet orifices on an air/fuel inlet end of a fuel nozzle, wherein at least one of the first plurality of metering orifices reduces an open cross-sectional area for at least one of the first plurality of air/fuel inlet orifices; and a second metering plate comprising a second plurality of metering orifices that align with a second plurality of air/fuel inlet orifices on the air/fuel inlet end of the fuel nozzle, wherein at least one of the second plurality of metering orifices reduces a second open cross-sectional area for at least one of the second plurality of air/fuel inlet orifices, and wherein the second metering plate has a larger diameter than the first metering plate.

9. The flow adjustment orifice system of claim 8, wherein the first metering plate and the second metering plate are configured to connect to an air/fuel inlet end of a fuel nozzle.

10. The flow adjustment orifice system of claim 9, wherein the first metering plate comprises a first metering ring and the second metering plate comprises a second metering ring.

11. The flow adjustment orifice system of claim 10, wherein the first metering ring and the second metering ring are concentrically aligned when connected to the air/fuel inlet end of the fuel nozzle.

12. The flow adjustment orifice system of claim 10, wherein the first metering ring comprises a first plurality of segments that are separable from one another.

13. The flow adjustment orifice system of claim 12, wherein the second metering ring comprises a second plurality of segments that are separable from one another.

14. The flow adjustment orifice system of claim 8, wherein each of the first plurality of metering orifices comprises a uniform cross-sectional profile.

15. A metered fuel nozzle for metered air/fuel inlet flow, the metered fuel nozzle comprising:

a first plurality of air/fuel inlet orifices disposed on an air/fuel inlet end of the metered fuel nozzle;

a first metering ring connected to the air/fuel inlet end of the metered fuel nozzle;

a first plurality of metering orifices disposed about the first metering ring in alignment with first plurality of air/fuel inlet orifices, wherein at least one of the first plurality of metering orifices reduces an open cross-sectional area for at least one of the first plurality of air/fuel inlet orifices;

a second plurality of air/fuel inlet orifices disposed on the air/fuel inlet end of the metered fuel nozzle;

a second metering ring connected to the air/fuel inlet end of the metered fuel nozzle, wherein the second metering ring has a larger diameter than the first metering ring; and a second plurality of metering orifices disposed about the second metering ring in alignment with second plurality of air/fuel inlet orifices, wherein at least one of the second plurality of metering orifices reduces a second open cross-sectional area for at least one of the second plurality of air/fuel inlet orifices.

16. The metered fuel nozzle of claim 15, wherein the first metering ring comprises a first plurality of segments that are separable from one another.

17. The metered fuel nozzle of claim 16, wherein the second metering ring comprises a second plurality of segments that are separable from one another.

18. The metered fuel nozzle of claim 15, wherein the first metering ring and the second metering ring are concentrically aligned.

* * * * *